US007819229B2

(12) United States Patent
Hänninen et al.

(10) Patent No.: US 7,819,229 B2
(45) Date of Patent: Oct. 26, 2010

(54) ELEVATOR SAFETY SYSTEM

(75) Inventors: Ari Hänninen, Hyvinkää (FI); Seppo Ketoviita, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/455,733

(22) Filed: Jun. 20, 2006

(65) Prior Publication Data

US 2007/0000734 A1 Jan. 4, 2007

Related U.S. Application Data

(63) Continuation of application No. PCT/FI2005/000002, filed on Jan. 3, 2005.

(30) Foreign Application Priority Data

Jan. 9, 2004 (FI) ..... 2004-0021

(51) Int. Cl.
*B66B 5/02* (2006.01)
*B66B 1/32* (2006.01)
*B66B 5/18* (2006.01)

(52) U.S. Cl. ..... 187/373; 187/288; 187/305; 187/350

(58) Field of Classification Search ..... 187/287, 187/305, 393, 350, 373, 291, 394, 288
See application file for complete search history.

(56) References Cited

U.S. PATENT DOCUMENTS

| | | | | |
|---|---|---|---|---|
| 1,444,614 | A * | 2/1923 | Kimball | 187/279 |
| 1,864,588 | A * | 6/1932 | Dunlop | 187/373 |
| 2,581,297 | A * | 1/1952 | Rissler | 187/375 |
| 4,923,055 | A | 5/1990 | Holland | |
| 4,928,796 | A * | 5/1990 | Poon | 187/288 |
| 4,977,982 | A | 12/1990 | Bialy et al. | |
| 5,002,158 | A | 3/1991 | Ericson et al. | |
| 5,101,937 | A * | 4/1992 | Burrell et al. | 187/350 |
| 5,183,979 | A | 2/1993 | Sheridan et al. | |
| 5,228,540 | A * | 7/1993 | Glaser | 187/355 |
| 5,648,645 | A * | 7/1997 | Arpagaus et al. | 187/393 |
| 5,869,794 | A * | 2/1999 | Spiess | 187/287 |
| 6,161,653 | A * | 12/2000 | Skalski et al. | 187/305 |
| 6,170,614 | B1 * | 1/2001 | Herkel et al. | 187/287 |
| 7,527,127 | B2 * | 5/2009 | Osterman et al. | 187/391 |
| 7,669,697 | B2 * | 3/2010 | Ueda et al. | 187/391 |
| 2005/0126862 | A1 * | 6/2005 | Ito | 187/350 |

(Continued)

FOREIGN PATENT DOCUMENTS

DE 39 17 594 A1 3/1990

(Continued)

*Primary Examiner*—John Q Nguyen
*Assistant Examiner*—Stefan Kruer
(74) *Attorney, Agent, or Firm*—Birch, Stewart, Kolasch & Birch, LLP

(57) ABSTRACT

An apparatus in an elevator for detecting and stopping an uncontrolled movement of the car when a machine brake intended to keep the elevator car immovable is on. The apparatus comprises a motion detector (1) for detecting movement of the car (2) and the length of the movement when the machine brake is on (10), a stopping device (3) for stopping an uncontrolled movement of the car, and limit and control means (4) for defining an allowed car movement and controlling the operation of the stopping device according to information obtained from the motion detector.

7 Claims, 3 Drawing Sheets

U.S. PATENT DOCUMENTS

Figure 1:
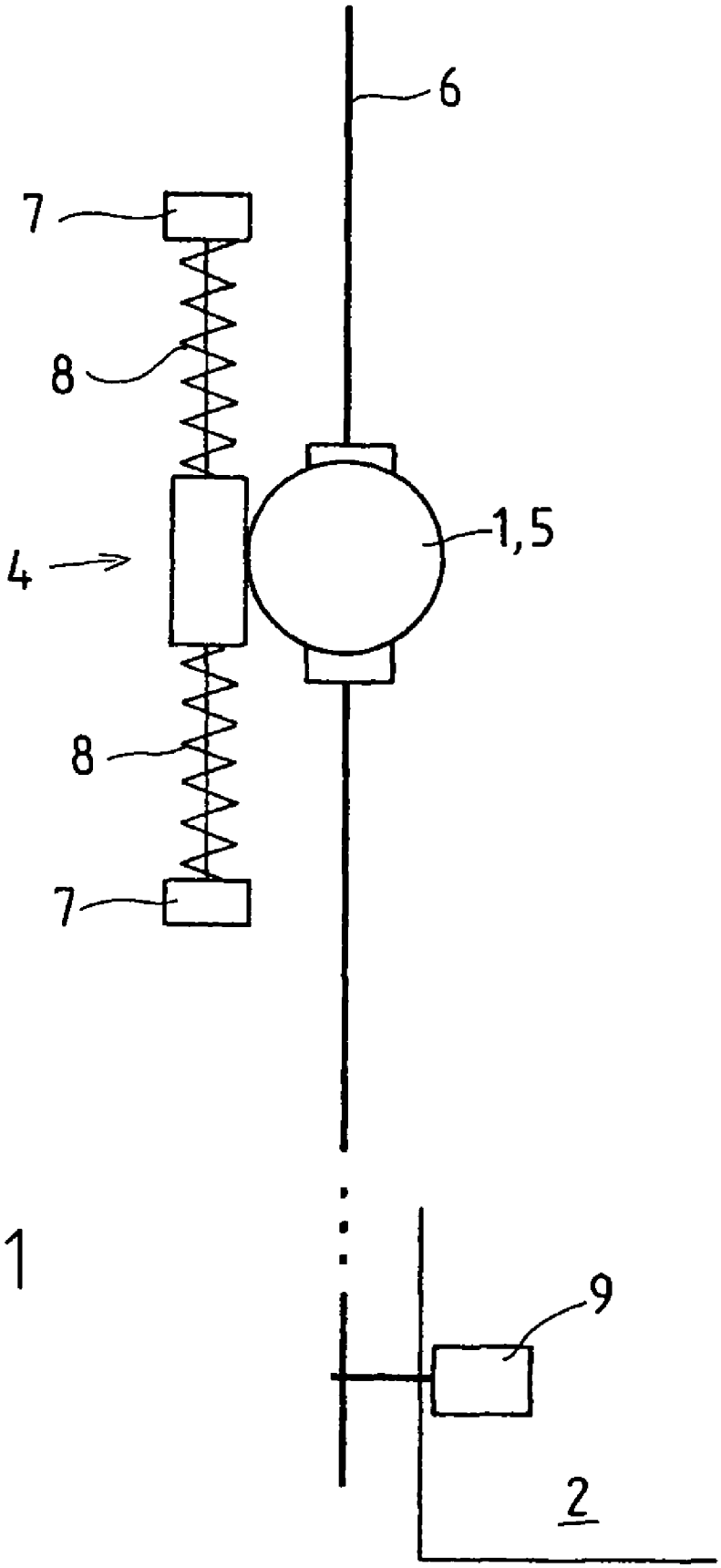

| | | | | |
|---|---|---|---|---|
| 2007/0227826 | A1* | 10/2007 | Nakagawa et al. | 187/252 |
| 2008/0185231 | A1* | 8/2008 | Osterman et al. | 187/247 |
| 2009/0133965 | A1* | 5/2009 | Mattila et al. | 187/288 |
| 2009/0178889 | A1* | 7/2009 | Harkonen et al. | 187/373 |

FOREIGN PATENT DOCUMENTS

| | | | | |
|---|---|---|---|---|
| JP | 09-221285 | A | | 8/1997 |
| JP | 2009166933 | A | * | 7/2009 |

* cited by examiner

ELEVATOR SAFETY SYSTEM

This application is a Continuation of co-pending PCT International Application No. PCT/FI2005/000002 filed on Jan. 3, 2005, which designated the United States, and on which priority is claimed under 35 U.S.C. §120. This application also claims priority under 35 U.S.C. §119(a) on patent application Ser. No. 20040021 filed in Finland on Jan. 9, 2004. The entire contents of each of the above documents is hereby incorporated by reference.

FIELD OF THE INVENTION

The present invention relates to elevator safety systems and to the brake equipment of elevator cars. In particular, the invention concerns an apparatus for detecting and stopping an uncontrolled movement of the car.

BACKGROUND OF THE INVENTION

An important aim in elevator systems is to maximize passenger safety. Free fall of the elevator car must be prevented and the motion must not reach an uncontrolled acceleration and consequent uncontrolled deceleration of motion. Even if a sudden stop occurs with a relatively low kinetic energy, passengers may suffer injuries.

When the elevator car has stopped at a landing or also if it has stopped between floors for some reason, the machine brake is triggered, in other words, the machine brake prevents or at least it should prevent both upward and downward movement of the car from the stopping position. The machine brake is generally arranged to engage the traction sheave.

When the machine brake is on and the car is standing still, generally also with the car doors open, the car should absolutely remain immovable. Only small movements due to changes in car load consequent rope elongations are allowed. These movements are of the order of 1-2 cm.

However, the machine brake may suffer faults that prevent its perfect operation. Maintenance may have failed, adjustments may be wrong, the brake shoes or only one of the brake shoes may be defective. It is also possible that electric release of the machine brake does not work and so the brake is continuously engaged. Therefore it may happen that, while the motor is powerful enough to move the elevator car, the brake is continuously chafing the traction sheave and after a sufficiently long time of operation the brake becomes inoperative and is no longer able to keep the car immovable when it should.

In new elevators, the above-mentioned problems have been eliminated by using equipment that in principle could also be used in old elevators already in use. However, this would require such large changes and additions to the structures of old elevators that it would be necessary to carry out a complete re-inspection of the elevators. In practice, the entire elevator would have to be renewed to an extent such that building a completely new elevator might even be more remunerative in long-term economics.

OBJECT OF THE INVENTION

The object of the present invention is to overcome the above-described drawbacks. A specific object of the invention is to disclose a safety arrangement that is applicable to older elevators in respect of both construction and economy, designed to prevent uncontrolled movements of the elevator car both at a landing and between landings.

DETAILED DESCRIPTION OF THE INVENTION

As for the features of the invention, reference is made to the claims.

The apparatus of the invention is intended for use in an elevator to detect and stop an uncontrolled movement of the elevator car when the machine brake designed to keep the elevator car immovable is on. According to the invention, the apparatus comprises a motion detector for detecting a movement of the car and the length of such movement when the machine brake is on. In addition, the apparatus comprises, in addition to the machine brake, a stopping device for stopping an uncontrolled movement of the elevator car and limit and control means for defining the car movement allowed when the machine brake is on and for controlling the operation of the stopping device according to information obtained from the motion detector.

In an embodiment of the invention, the motion detector consists of a gripping means arranged to grip an elevator component moving with the car, e.g. the driving rope or the overspeed governor rope. The brake lock is preferably an electrically operated locking device which performs the locking mechanically e.g. by spring force or by wedging and which can be held in the disengaged state by electric control. This ensures that the brake will remain in the locked state in all failure situations. The most advantageous and accurate object of application of the brake lock is the over-speed governor rope. This is because the overspeed governor rope always follows exactly the motion of the elevator car but in a normal situation it is not subjected to any significant forces that would cause elongation of the ropes, whereas such forces are applied to the car suspension ropes as the car load varies so much that car movements of a few centimeters are possible so that they cannot be detected from the suspension ropes at the upper end of the elevator shaft. The apparatus of the invention is preferably placed in the elevator machine room or in its immediate vicinity, i.e. generally above the elevator shaft. Therefore, the distance between the apparatus and the elevator car is large when the car is in the lower end of the elevator shaft in this situation the rope elongation may also be a significant factor in the determination of the position of the car. Of course, in the case of an elevator with machine below, the distance may be even larger as the hoisting rope is passed from the car over a diverting pulley in the upper part of the shaft down to the machine room.

The limit and control means preferably comprise switches, mechanical or electric detectors, which, when operated, have been arranged to activate the stopping device.

In another embodiment of the invention, the motion detector consists of a pulse sensor or an equivalent device that detects movement of the car or an elevator component moving together with the car. The pulse sensor has been arranged to produce a pulse sequence proportional to car movement, and the limit and control means comprise a comparing element for comparing the pulse count given by the pulse sensor to a set limit value and a switch for activating the stopping device when the limit value is exceeded. The pulse sensor, too, is preferably connected to or in contact with the overspeed governor rope.

The invention does not prescribe the placement and type of the stopping device that can be used in it. In a preferred embodiment of the invention, the stopping device used is a safety gear connected to the overspeed governor rope and engaging the elevator guide rails, so the apparatus can be implemented using the safety gear already provided in conjunction with the elevator car and operated by the overspeed governor, thus avoiding the need for separate stopping devices.

However, it is also possible to use separate stopping devices. In this case, the stopping device may be e.g. a device braking the rotation of the traction sheave, motor or motor shaft of the elevator, or the stopping device may be e.g. a braking device secured to the car guide rails or also a brake device engaging the hoisting ropes or the counterweight balancing ropes.

The limit and control means are preferably provided with a delay function to allow the machine brake a sufficient time to stop the car in normal situations, If the apparatus of the invention were always immediately activated at the same time when the machine brake of the elevator is engaged, it might well be possible that, especially when some slippage of the machine brake occurs, the apparatus of the invention would already operate even if the machine brake would stop the car in a completely acceptable manner, When a delay of e.g. about 0.5 second is provided between the engagement of the machine brake and the activation of the apparatus of the invention, the car can be stopped in position in normal situations.

ADVANTAGES OF THE INVENTION

The advantages of the invention are related to economically extending the useful life and improved safety of old elevators. The apparatus of the invention does not in itself reduce the risk of starting of uncontrolled motion of the elevator car, but in such situations it prevents damage and injuries by stopping the car before its speed or distance traveled exceeds the stipulated limits. A further advantage is the simplicity of the apparatus, which allows it to be easily installed in existing old elevators without making large and expensive changes in their structures, even by making use of existing safety gears, in which case no separate stopping devices are needed.

LIST OF FIGURES

Figure 2:
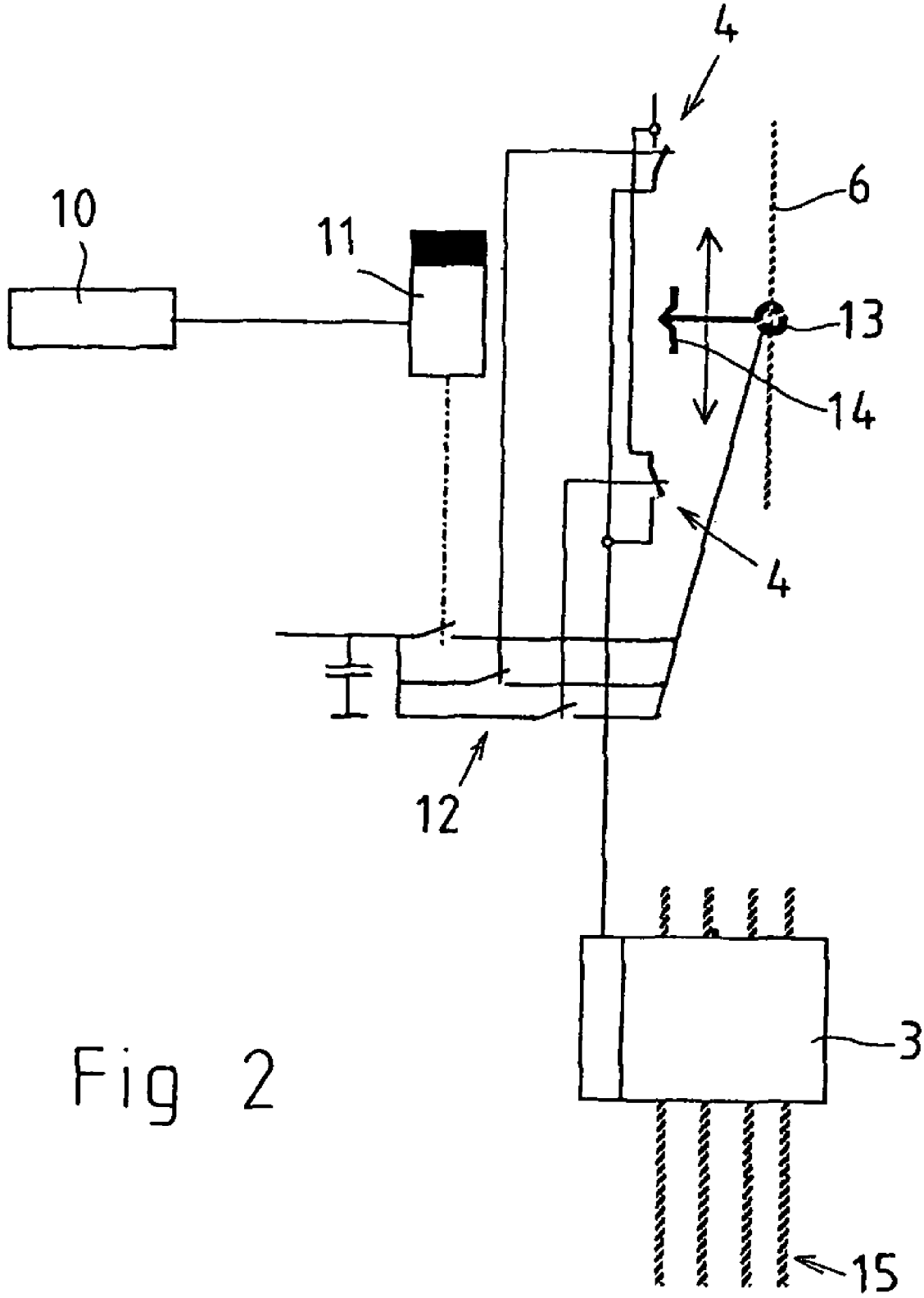
Figure 3:
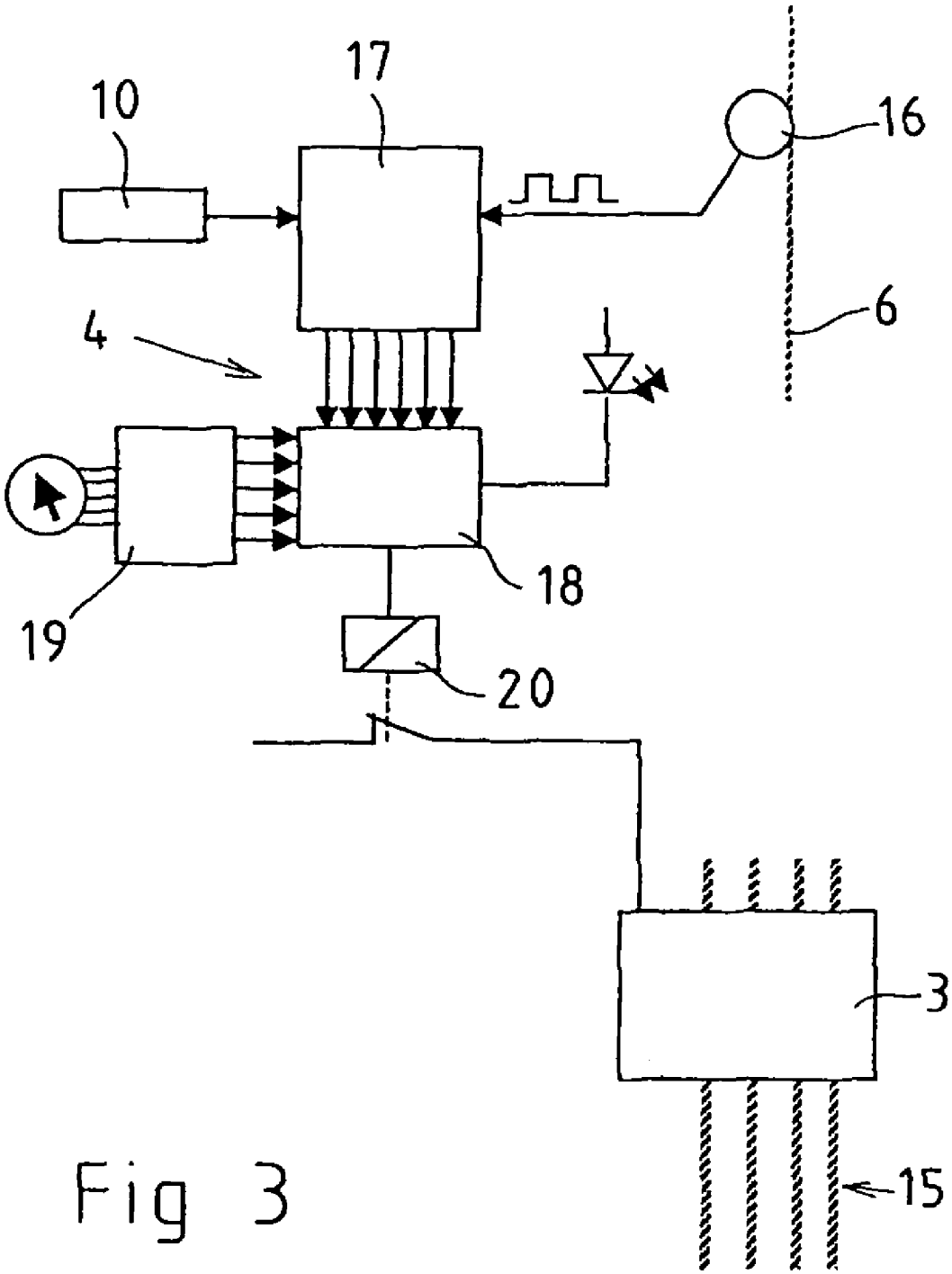

FIG. 1 is a diagrammatic representation of an apparatus according to the invention, FIG. 2 is a diagrammatic representation of a second apparatus according to the invention, and FIG. 3 is a diagrammatic representation of a third apparatus according to the invention.

DETAILED DESCRIPTION OF THE FIGURES

FIG. 1 presents a preferred embodiment of the invention in which a separate stopping device such as an auxiliary brake is not necessarily needed to stop the car 2 from uncontrolled motion. In this embodiment, the motion detector 1 is a drag reel 5, which grips the overspeed governor rope 6 when the machine brake of the elevator should be on, i.e. when the car should remain immovable. In addition, the device comprises adjustable limits 7, and upon reaching these limits the drag reel 5 triggers an auxiliary brake 3. Thus, when the limits 7 are reached, it is possible to break the safety circuit, close the auxiliary brake or trigger the safety gear 9 provided in conjunction with the car 2 and operated by the overspeed governor. The device also comprises e.g. springs 8, which always return the drag reel 5 to the initial position when the brake is released, i.e. when the grip on the overspeed governor rope 6 is relaxed.

In a case where the safety gear 9 operated by the overspeed governor is used as an auxiliary brake, the drag reel 5 is arranged to engage the overspeed governor rope 6 with a force that will cause the safety gear to be triggered, but after the triggering the overspeed governor rope is allowed to slide through the drag reel.

In the second embodiment of the invention illustrated in FIG. 2, when the machine brake 10 of the elevator is engaged, the apparatus of the invention is also engaged after a suitable delay. The delay is implemented using e.g. a pneumatically delayed contactor 11, which closes the switches 12 with a desired delay. It is possible to use a hydraulic, mechanical or electrical contactor or a suitable combination of these, but a pneumatic contactor is preferred as it will also work in the event of a power failure, In this case, a gripping means 13 grips the over-speed governor rope 6. Arranged to move with the gripping means 13 is an activating element 14, which meets limit and control switches 4 at upper and lower positions as it travels.

Arranged in conjunction with the hoisting and/or compensating ropes of the car is a stopping device 3. When the car moves in an uncontrolled manner in either direction and reaches the prescribed limit, the corresponding switch 4 will close. In this situation, the stopping device 3 is instructed to operate and it engages the hoisting ropes 15, preventing their motion and thereby stopping the motion of the car. Thus, whenever the machine brake 10 is on, the apparatus will prevent any car movements exceeding the defined limits. When the machine brake 10 is released, switch 11 will open switches 12, thus interrupting the control signal to the brake lock 13, which will release its grip on the overspeed governor rope 6.

FIG. 3 presents an apparatus substantially corresponding to the embodiment illustrated in FIG. 2, but it is implemented using more electrical functions instead of mechanical components. In this embodiment, the motion detector 1 is a pulse sensor 16, which receives a control signal from the motion of the overspeed governor rope 6. When the machine brake 10 is engaged, it activates a pulse counter 17, which receives the pulses sent by the pulse sensor 16, the number and direction of which is proportional to the motion of the overspeed governor rope 6. A comparing element 18 compares the number of pulses counted to a limit value set by means of a setting device 19. When limit value is exceeded in either direction, the comparing element 18 will close switch 20, with the result that a control voltage is admitted to the auxiliary brake 3, which engages suitable ropes 15, thus stopping these ropes and with them the elevator car.

When the car starts moving in a normal manner, the machine brake 10 is released and at the same time the pulse counter 17 is deactivated. Thus, the apparatus only observes car movements when the machine brake 10 is in operation, i.e. when the car should remain immovable within prescribed limits.

The invention is not limited to the embodiment examples described above; instead, many variations are possible within the scope of the inventive concept defined in the claims. In the example, the overspeed governor rope is used, but nothing prevents the invention from being applied to the car or counterweight ropes or the compensating ropes. Thus, the apparatus of the invention is a kind of general monitoring device that can be used to control any stopping device and that can be placed anywhere. The stopping device may be e.g. a safety gear, an auxiliary brake, a motor or a combination of these.

The invention claimed is:

1. An apparatus in an elevator for detecting and stopping an uncontrolled movement of a car when a machine brake intended to keep an elevator car immovable is on, the apparatus comprising:

a motion detector configured to detect uncontrolled movement of the car when a machine brake is already actuated and to detect a length of the movement when the machine brake is on, said motion detector including a gripper arranged to grip an elevator component moving with the car immediately when the machine brake is on or after a predetermined delay after the machine brake is on, said motion detector being configured to use the gripper for detection of the length of the uncontrolled movement of the car;

a stopping device configured to stop the uncontrolled movement of the car when the length of the uncontrolled movement of the car detected by the motion detector reaches a predetermined distance after the gripper grips the elevator component during an on period of the machine brake, thereby stopping the uncontrolled movement of the car; and switches or limits placed at positions above and below the gripper, said switches or said limits being arranged to activate the stopping device.

2. The apparatus according to claim 1, wherein the stopping device is a safety gear connected to an overspeed governor rope and engaging elevator guide rails.

3. The apparatus according to claim 1, wherein the stopping device is a device braking the rotation of a traction sheave, motor or motor shaft of the elevator.

4. The apparatus according to claim 1, wherein the stopping device is a brake device engaging a car rope(s) or counterweight rope(s).

5. The apparatus according to claim 1, further comprises a delay that allows the machine brake a sufficient time to stop the car in normal situations.

6. The apparatus according to claim 1, wherein the elevator component is a hoisting rope.

7. The apparatus according to claim 1, wherein the elevator component is an overspeed governor rope.

* * * * *